United States Patent [19]

Damron

[11] 4,273,503

[45] Jun. 16, 1981

[54] PRESSURE-FLUID SUPPLY SYSTEM

[76] Inventor: Tony R. Damron, 37923 Shenandoah Lp., Springfield, Oreg. 97477

[21] Appl. No.: 80,708

[22] Filed: Oct. 1, 1979

[51] Int. Cl.[3] ..... E02F 9/22

[52] U.S. Cl. ..... 414/694; 414/555; 414/687; 60/477

[58] Field of Search ..... 414/687–694, 414/543, 555, 734, 738, 739, 742, 743, 550; 212/245, 247; 60/DIG. 10, 325, 477; 180/85, 6.58, 6.6, 305, 307, 308

[56] References Cited

U.S. PATENT DOCUMENTS

| | | | |
|---|---|---|---|
| 2,949,162 | 8/1960 | Davis | 180/85 |
| 3,319,813 | 5/1967 | Beyea | 414/688 |
| 3,445,014 | 5/1969 | Kullerback | 414/550 |
| 3,966,249 | 6/1976 | Lindqvist | 414/694 X |
| 4,044,902 | 8/1977 | Eitel | 212/247 X |
| 4,102,461 | 7/1978 | Soyland | 414/689 X |

*Primary Examiner*—Stephen G. Kunin
*Assistant Examiner*—Terrance L. Siemens
*Attorney, Agent, or Firm*—Kolisch, Hartwell & Dickinson

[57] ABSTRACT

A pressure-fluid supply system for use in a hydraulic loader device. Included in the device are a mast mountable on a truck, a platform rotatably mounted on the upper end of the mast, and hydraulic fluid-operated equipment carried on the platform for rotation therewith. The supply system includes a pump anchored on the platform, for supplying hydraulic fluid to the equipment carried thereon, and an engine mounted on the mast. The engine's power output is drivingly coupled to the pump about the platform's axis of rotation, wherein the platform may be rotated endlessly during pump operation.

6 Claims, 3 Drawing Figures

PRESSURE-FLUID SUPPLY SYSTEM

BACKGROUND AND SUMMARY OF THE INVENTION

The present invention relates to pressure-fluid supply systems, and in particular, to a system for use in combination with a boom loader device.

Hydraulically controlled boom loaders are widely used in the logging industry and elsewhere. Conventionally, a boom loader includes a mast designed to be secured to the bed of a truck or the like. The mast may have a pair of opposed, hydraulically controlled legs, or outriggers, which are extensible to positions contacting the ground on either side of the truck bed to stabilize the loader. Mounted on the upper end of the mast, for rotation relative thereto, is a platform on which the loader's hydraulically controlled boom and grapple are carried. Typically, the hydraulic equipment carried on the platform includes six units which must be supplied with pressure fluid. These are a motor for controlling the rotational position of the platform; a motor for controlling the rotational position of the grapple; a pair of rams controlling movement of the boom arms; and a pair of rams controlling movement of the grapple arms. In addition, as noted above, the two outriggers on the mast must be separately supplied with pressurized hydraulic fluid.

In the past, a common type of hydraulic fluid supply system used in such a boom loader is one powered by a take-off pump unit connected to the truck's drive system. The pump receives hydraulic fluid from a fluid reservoir contained in the loader's mast, and supplies pressurized hydraulic fluid to the loader's hydraulic units. Pressurized hydraulic fluid is supplied from the pump to a valve on the mast for controlling the two outriggers, and to a valve on a platform, for controlling the (six) hydraulic units carried thereon. Supply of pressurized fluid from the pump to the valve on the relatively rotatable platform, and from such valve back to the reservoir in the mast occurs through a rotary fluid seal interconnecting the mast and the platform.

Two major problems are inherent in the just-described fluid supply system used in conventional boom loaders. First, setting up the loader on the truck requires a number of time-consuming and relatively expensive operations, including attaching the pump to the truck's drive system, and connecting the pump to the various loader fluid ports. Not uncommonly, such set up requires several days and may cost several thousand dollars. Accordingly, once the loader is mounted on, and connected to the truck, economy dictates that it remain there, thus limiting the use of the truck for other purposes.

A second problem concerns the use of a rotary fluid seal to transport hydraulic fluid between the stationary mast and the relatively rotatable loader platform. Such seals are expensive, bulky, and relatively difficult to maintain.

A general object of the present invention to provide, for use with a truck-mounted boom loader device, a fluid supply system which overcomes the above-mentioned problems encountered in the prior art.

More specifically, it is an object of the present invention to provide such a fluid supply system which operates independently of the drive system of a truck on which the loader device is mounted.

Yet another object of the present invention is to provide such fluid supply system which obviates the need for a rotary seal between a loader's mast and rotatable platform.

Another related object of the present invention is to provide a boom loader which can be mounted and dismounted readily from the bed of a truck or the like.

The present invention includes a pressure-fluid supply system for use in combination with a pair of relatively rotatable structures, where one structure is intended to carry fluid-operated equipment to be operated by the system. The system includes a pump unit having a stator portion anchored on one of the relatively rotatable structures, and a power-input rotor rotatably mounted thereon. Also included in the system is a power-operated prime mower including a stator portion anchored to the other of the two relatively rotatable structures, and a power-output rotor rotatably mounted thereon. The power-output rotor is drivingly coupled to the pump's rotor, about the axis of rotation of the one structure, relative to the other, wherein the one structure may be rotated endlessly during pump operation.

In a preferred embodiment of the invention, the two rotatable structures are the mast and platform of a loader device, with fluid-operated equipment being carried on the platform. The system includes a fluid reservoir which is mounted on the platform for rotation therewith. The pump is connected to the equipment and to the reservoir, forming therewith, a self-contained fluid supply and exhaust apparatus.

These and other objects and features of the present invention will become more fully apparent when read in connection with the following detailed description of a preferred embodiment of the invention, and the accompanying drawings, wherein.

DETAILED DESCRIPTION OF A PREFERRED EMBODIMENT OF THE INVENTION

Figure 1:
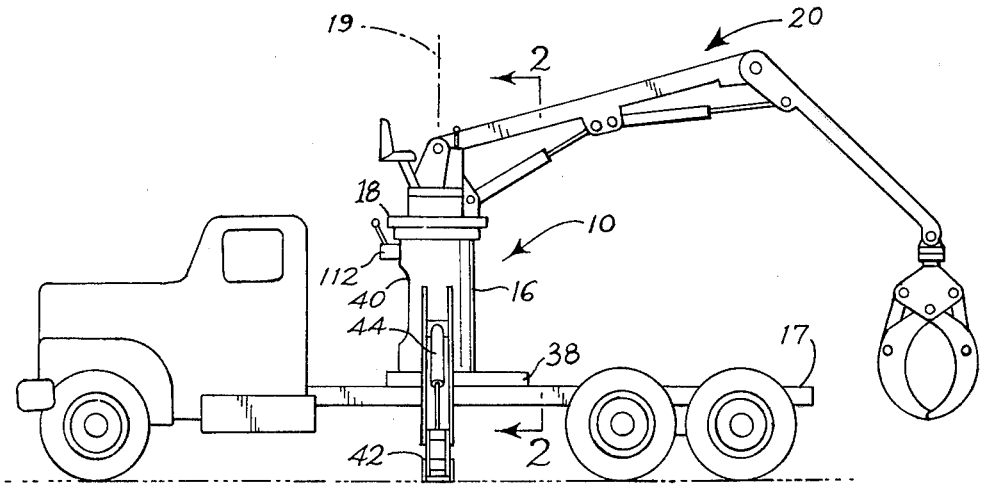
FIG. 1 is a side view of a truck-mounted loader device utilizing the fluid-supply system of the present invention.
Figure 2:
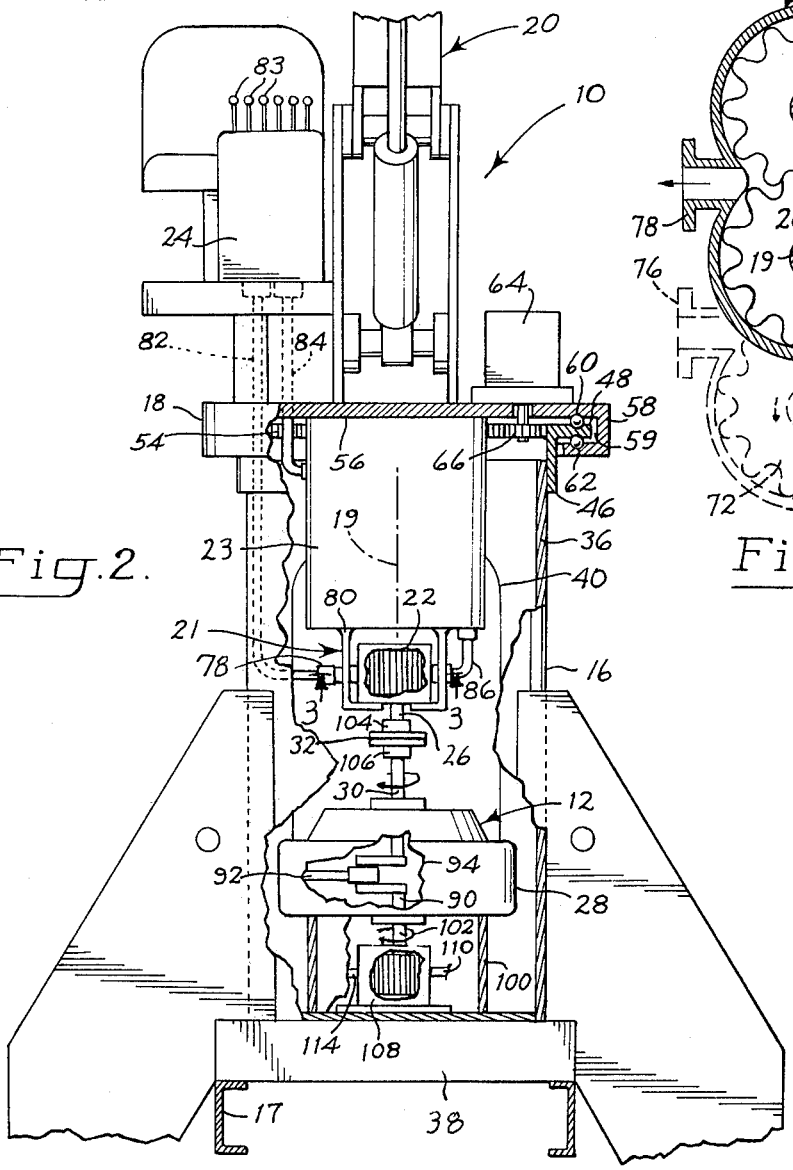
FIG. 2 is a side, partially cutaway view of portions of the loader device and fluid supply system, taken along line 2—2 in FIG. 1.

Indicated at 10 in FIGS. 1 and 2 is loader device adapted to be operated by the pressure-fluid supply system 12 (FIG. 2) of the present invention. Device 10 generally includes a mast 16 adapted to be mounted on a truck bed 17. A platform 18 is mounted on the upper end of mast 16, for rotation relative thereto, about an upright axis, indicated by dashed-dot line at 19. A knuckle boom, indicated at 20 in FIG. 1, is carried on platform 18, for rotation therewith.

As seen in FIG. 2, system 12 generally includes a self-contained fluid supply and exhaust apparatus 21 mounted on platform 18, for rotation therewith. Apparatus 21 is composed, generally, of a pump 22, a reservoir 23 and a valve 24. Pump operation is produced by driven rotation of a pump power-driveable input shaft 26. System 12 further includes a prime mover including an engine 28 mounted on mast 16 and having a power output shaft 30. Operation of engine 28 produces driving rotation of shaft 30 about axis 19. Shaft 30 is drivingly coupled to shaft 26 by a coupler 32.

Considering details of device 10, mast 16 is formed of an upright metal-walled cylinder 36 (FIG. 2) which is attached, as by welding, at its bottom end to a base 38. The latter is mountable on bed 17, conventionally. Formed in one side of cylinder 36, as seen in FIG. 1, is a window 40 which provides installation and repair access to machinery contained within the interior of the mast. A pair of legs, or outriggers, such as outrigger 42, seen in FIG. 1, is attached to opposed sides of mast 16. Each outrigger is positionable by a ram, such as ram 44, between raised, transport positions and lowered, ground-contacting positions (shown in FIG. 1) in an entirely conventional manner.

A platform-support sleeve 46 is secured, as by welding, to the upper open end of cylinder 36, as shown in FIG. 2. Sleeve 46 includes a flanged, outwardly extending lip portion 48 on which platform 18 is rotatably mounted in a manner to be described. A circumferential gear track 54 is formed on an inner annular portion of sleeve 46, for a purpose to be described.

Platform 18 includes a circular plate 56 dimensioned to extend beyond the sides of cylinder 36, as seen in FIG. 2. Integrally formed with plate 56 is a downwardly extending ring 58 which is bent inwardly at its lower end, forming, with plate 26, a generally U-shaped annular channel 59. This channel has formed in its upper and lower sides, upper and lower circular grooves respectively, which confront, and are coincident with, upper and lower circular grooves in lip portion 48, respectively. Interposed between the two just-mentioned upper grooves and the two just-mentioned lower grooves are plural bearing spheres, such as spheres 60, 62, respectively, providing upper and lower bearing surfaces on which platform 18 rotates relative to mast 16. A bi-directional hydraulic motor 64 mounted on the upper surface of plate 56, as shown, drives a gear 66, which co-acts with track 54 to effect rotation of platform 18 on mast 16 in a selected direction.

Details of system 12, and first of apparatus 21 thereof, will now be described. Reservoir 23 is mounted centrally on the lower surface of plate 56, for rotation therewith about axis 19. The reservoir is a cylindrical drum whose storage capacity for hydraulic fluid is sufficient to supply the hydraulic fluid requirements of motor 64 and boom 20 mounted on platform 18.

Figure 3:
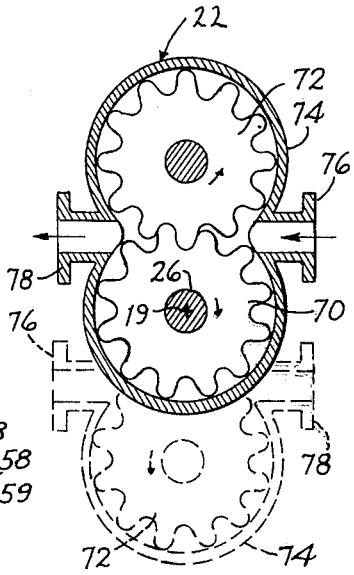
FIG. 3 is an enlarged sectional view, taken along line 3—3 in FIG. 2, showing a pump unit in two relatively rotated positions.

With reference now to FIG. 3, pump 22 is a conventional rotary gear pump having two mated gears 70, 72 rotatably mounted within, and closely fitting, the interior of the pump's casing or housing 74. Gear 70, which is connected to shaft 26 for rotation therewith, serves as the driver gear, and gear 72, which is driven by gear 70, as the follower gear. Housing 74 includes intake and exhaust ports 76, 78, respectively, which are aligned with intermeshing portions of gears 70, 72, as shown. According to conventional pump operation, counterrotation of the two pump gears, produced by driven rotation of shaft 26, acts to pump fluid from port 76 to port 78. Housing 74 is also referred to herebelow as a pump stator portion, and gears 70, 72 and input shaft 26, as a pump rotor portion.

Pump 22 is anchored on platform 16, for rotation therewith, about axis 19, by a pair of brackets, such as bracket 80, secured to the bottom of reservoir 23, as seen in FIG. 2. The pump is so mounted that shaft 26 is aligned with axis 19, wherein rotation of pump 22, which accompanies (e.g. 180°) rotation of platform 18, occurs about the axis of rotation of gear 70—namely axis 19—as seen in FIG. 3. According to an important feature of the present invention, this configuration permits the pump's stator portion to rotate slowly relative to the rapidly rotating pump rotor portion during loader operation.

Valve 24 is a conventional six-chambered hydraulic valve which is mounted on platform 18 for rotation therewith. Pressurized hydraulic fluid is supplied to valve 24 from pump 22 by a hose 82 connecting port 78 to the valve. Supply of hydraulic fluid from each chamber of valve 23 to the associated hydraulically controlled unit on platform 18 is operator-controllable by one of six valve levers, such as levers 83, as is conventional. Hydraulic fluid exhausted from the just-mentioned hydraulic units to valve 24 is returned to reservoir 23 by a hose 84. Hydraulic fluid is supplied from reservoir 23 to inlet port 76 of pump 22 by a hose 86. Hoses 82, 84, and 86 are also referred to herein as conduit means. Thus, apparatus 21, which includes the just-named conduit means, provides a self-contained fluide and exhaust circuit in which fluid circulates from reservoir 23 to pump 22, from pump 22 to valve 24, and from valve 24 to the fluid-operated equipment and back to reservoir 23. As noted above, apparatus 21 rotates, with platform 18, as a unit about axis 19, with such rotation being accommodated by relative rotation between gears 70, 72 and housing 74.

Engine 28 is an internal combustion engine supplied with fuel from a fuel source, such as the vehicle fuel tanks. Engine 28, which is also referred to herein as prime mover means, is a rotary type engine having a plurality of angularly spaced cylinders (not shown) the pistons of which (not shown) are connected to a crank shaft 90 by means of tie rods, such as rod 92. The engine housing 94, which includes the just-mentioned cylinders, is securely mounted on base 38 by plural upright posts, such as post 100. Thus mounted, the upper and lower ends of shaft 90, which form upper and lower power-output shafts 30, 102, respectively, rotate about axis 19. The engine's housing is also referred to herebelow as a stator portion, and crank shaft 90, and the pistons operatively connected thereto, is also referred to herebelow as a rotor portion.

Coupler 32 is a conventional shaft coupler having a pair of intermeshing gear sections 104, 106 mounted on shafts 26, 30, respectively, for rotation therewith. Coupler 32 is also referred to herein as coupling means.

Mounted directly below engine 28, on base 38, is a second hydraulic fluid pump 108. This pump is similar to pump 22, above described, and includes a housing mounted on base 38, and a pair of rotatable gears, the drive gear of which is mounted on shaft 102 for rotation therewith about axis 19. Hydraulic fluid is supplied from a fluid reservoir (not shown) mounted on mast 12 by a hose, shown fragmentarily at 110 in FIG. 2. Pressurized fluid is supplied from pump 108 to a two-chambered valve 112 (FIG. 1) by a hose shown fragmentarily at 114 in FIG. 2. Valve 112 is operatively connected to the above-mentioned outriggers for controlling the operation thereof.

Operation of the present invention in its intended setting on the bed of a truck will now be described. Initially, to operate device 10, engine 28 is started, and adjusted to a desired operating speed by conventional carburetor controls (not shown). The engine operation delivers power to output shafts 30, 102, producing driven rotation of these about axis 19. Such, in turn, produces rotation of the pump gears in pumps 22, 104, respectively, producing hydraulic fluid pumping thereby. Pumps 22, 104 supply pressurized hydraulic fluid to valves 24, 112, respectively, to permit operation of associated hydraulic units.

When it is desired to rotate platform 18 relative to mast 16, hydraulic motor 64 is operated, by selected activation of the associated lever on valve 24, producing rotation of platform 18, and apparatus 21 mounted thereon, relative to the mast about axis 19. During such rotation, pump gear 70, acting under the influence of the power output of shaft 30, continues to rotate rapidly within pump housing 74, providing continuous pumping action during platform rotation.

From the above, it can be appreciated how various objects of the present invention are met. First, a loader employing the fluid supply apparatus of the present invention is substantially self-contained, and requires no hydraulic fluid hookup with the vehicle onto which the loader is mounted. This feature greatly increases the ease with which the loader can be mounted on and dismounted from the bed of a truck, or the like. A second important advantage is that the fluid supply system of the invention obviates the need for a rotary fluid coupling between the mast and the platform of the loader, as has been required in the prior art. This has been accomplished by the novel expedient of separating the fluid supply system into a driving unit, including engine 28, mounted on the stationary mast and a self-contained fluid supply and exhaust apparatus—including a pump and a fluid reservoir—which is mounted on the rotatable platform. The pump includes a relatively rotatable rotor by which the fluid supply and exhaust apparatus is drivingly coupled to the relatively stationary driving unit.

While a preferred embodiment of the invention has been described herein, it is evident that various changes in modifications may be made without departing from the spirit of the invention.

It is claimed and desired to secure by Letters Patent:

1. A pressure fluid supply system for use in combination with a pair of relatively rotatable structures where one structure is intended to carry fluid-operated equipment intended to be operated by said system, said system in operative condition comprising, self-contained fluid supply and exhaust apparatus operatively connectable with said fluid-operated equipment and including a pump unit having a stator portion anchored to said one structure and a power-driveable rotor portion rotatably mounted with respect to said stator portion, power-operated prime mover means including a stator portion anchored to the other structure, and a power-outputable rotor portion rotatably mounted with respect to the prime mover means' stator portion, and means drivingly coupling said two rotor portions.

2. The system of claim 1 wherein said one structure and said two rotor portions are relatively rotatable about a substantially common axis.

3. A pressure fluid supply system for use in combination with a loader device having a mast mountable on a truck bed or the like, a platform mounted on said mast for rotation relative thereto, and pressure-fluid-operated equipment carried on said platform, for rotation therewith, said system comprising, in operative condition, a pump anchored on said platform for rotation therewith, said pump including a housing, and a power-input shaft mounted on the pump housing for rotation relative thereto, conduit means mounted on said platform operatively connecting said pump housing and said equipment, a prime mover including a housing anchored on said mast and a power-output shaft mounted on the mover housing for rotation relative thereto, and means drivingly coupling said power-output shaft to said power-input shaft.

4. The system of claim 3 wherein said platform and said two shafts are rotatable about a substantially common axis.

5. The system of claim 3 which further includes a fluid reservoir mounted on said platform for rotation therewith, and wherein said conduit means includes a conduit connecting said reservoir and said housing.

6. In a loader device having a mast, a platform mounted on the mast for rotation relative thereto, and pressure fluid-operated equipment carried on the platform for rotation therewith, a method of supplying pressure fluid to such equipment comprising mounting a fluid-containing reservoir on the platform for rotation therewith, anchoring a pump on the platform for rotation therewith, such pump having a relatively rotatable power-input shaft, operatively connecting the pump to such equipment, and to the reservoir, to form therewith a pump-operated self-contained fluid supply and exhaust apparatus, anchoring a prime mover on the mast, the mover having a relatively rotatable power-output shaft, drivingly coupling the power-output shaft to the power-input shaft, and operating the prime mover, and with said operating, transmitting power from the mover to the pump to operate the latter.

* * * * *